US005442152A

United States Patent [19]

Huang

[11] Patent Number: 5,442,152

[45] Date of Patent: Aug. 15, 1995

[54] COMPUTER KEY SWITCH

[75] Inventor: Chih-Lun Huang, Taipei Hsien, Taiwan

[73] Assignee: Focus Electronic Co., Ltd., Taipei, Taiwan

[21] Appl. No.: 313,881

[22] Filed: Sep. 28, 1994

[51] Int. Cl.[6] ..... H01H 13/70

[52] U.S. Cl. ..... 200/345; 200/341; 200/512; 200/521

[58] Field of Search ..... 200/345, 341, 512, 515, 200/520, 521, 534, 517, 344, 521, 523, 524, 525; 267/179, 180

[56] References Cited

U.S. PATENT DOCUMENTS 5,173,578 12/1992 Tame ..... 200/345

5,380,970 1/1995 Mizuno et al. ..... 200/517

*Primary Examiner*—Henry J. Recla

*Assistant Examiner*—David J. Walczak

*Attorney, Agent, or Firm*—William E. Pelton

[57] ABSTRACT

A film with a first circuit printed on a lower surface, a film insulator and a film with a second circuit printed on an upper surface are mounted on the keyboard. Each of the first and second circuits includes a plurality of contacts. The film insulator defines a plurality of apertures. One of the contacts of the first circuit will be engaged with one of the contacts of the second circuit through one of the apertures defined in the film insulator if a key switch is pressed. The key switch includes a frame defining two vertical slots. A slidable member includes a plate, two hooks projecting downwardly from the plate and each including a barb for engaging with one of the vertical slots and a hollow cylinder projecting downwardly from the plate and defining two vertical slots. A cup includes two barbs projecting radially inwardly therefrom. The hollow cylinder is insertable in the cup. The barbs formed on the cup are engageable in the slots defined in the hollow cylinder. A spring is received in the hollow cylinder and the cup for biasing the cup from the hollow cylinder. A resilient member is formed as an inverted funnel. The resilient member includes a closed upper end and an open lower end mounted on the first circuit and a boss projecting downwardly from the closed upper end thereof for engaging the contact of the first circuit with the contact of the second circuit.

3 Claims, 2 Drawing Sheets

COMPUTER KEY SWITCH

BACKGROUND OF THE INVENTION

The present invention relates to a computer keyboard. Particularly, this invention relates to a key switch mounted on a computer keyboard.

A key includes a key top and a key switch on which the key top is mounted. The key top is an element touchable by a finger of an operator of the keyboard. The key switch is an element mounted on the keyboard. There are two major types of key switches.

The first type is a mechanical-type key switch. Such a mechanical-type key switch will click if the key top is pressed efficiently. The click becomes an important signal to an operator. Moreover, each of the key switches can be repaired individually when it is broken. However, such key switches are operatively mounted on a printed circuit board mounted on a keyboard by means of soldering, thus involving sophisticated work which results in high cost.

The second type is a film-type key switch including a lower film mounted on a keyboard, a film insulator mounted on the lower film, and an upper film mounted on the film insulator. A lower surface of the upper film is printed with a first circuit including a plurality of contacts. The film insulator defines a corresponding number of apertures. An upper surface of the lower film is printed with a second circuit including a corresponding number of contacts. A silicone rubber membrane is mounted on the keyboard. A plurality of hollow seats project from an upper surface of the silicone rubber membrane. Each of the hollow seats includes a top and a periphery. A protrusion projects from a lower surface of the top of each of the hollow seats. One of the contacts of the first circuit will be engaged with one of the contacts of the second circuit through one of the apertures defined in the film insulator by means of the protrusion projecting from one of the hollow seats if the hollow seat is pressed. Such key switches involve simple work, thus resulting in low cost. However, each of such key switches will not click when it is pressed, therefore, will not send a signal to an operator. Furthermore, the whole film from which the hollow seats project will have to be removed if one of the hollow seats is broken.

This invention is intended to solve the above-mentioned problem by merging the advantages of the two above-mentioned types of key switches.

SUMMARY OF THE INVENTION

It is an objective of this invention to provide a key switch of a keyboard. A film with a first circuit printed on a lower surface, a film insulator and a film with a second circuit printed on an upper surface are mounted on the keyboard. The first circuit includes a plurality of contacts. The film insulator defines a plurality of apertures corresponding to the contacts of the first circuit. The second circuit includes a plurality of contacts corresponding to the apertures defined in the film insulator. One of the contacts of the first circuit will be engaged with one of the contacts of the second circuit through one of the apertures defined in the film insulator if the key switch is pressed.

It is another objective of this invention to provide a key switch which will click when it is pressed efficiently.

It is another objective of this invention to provide a key switch which can be easily manufactured.

It is another objective of this invention to provide a key switch which can be individually repaired or replaced with a new key switch when it is broken.

The objectives of this invention are achieved by providing a key switch including a frame defining two vertical slots. A slidable member includes a plate, two hooks projecting downwardly from the plate and each including a barb formed on a free end for engaging with one of the vertical slots and a hollow cylinder projecting downwardly from the plate and defining two vertical slots. A cup includes two barbs projecting radially inwardly therefrom. The hollow cylinder is insertable in the cup. The barbs formed on the cup are engageable in the slots defined in the hollow cylinder. A spring is received in the hollow cylinder and the cup for biasing the cup from the hollow cylinder. A resilient member is formed as an inverted funnel, i.e., it includes a closed upper end and an open lower end mounted on the first circuit and a boss projecting downwardly from the closed upper end thereof for engaging the contact of the first circuit with the contact of the second circuit.

DETAILED DESCRIPTION OF THE INVENTION

Figure 1:
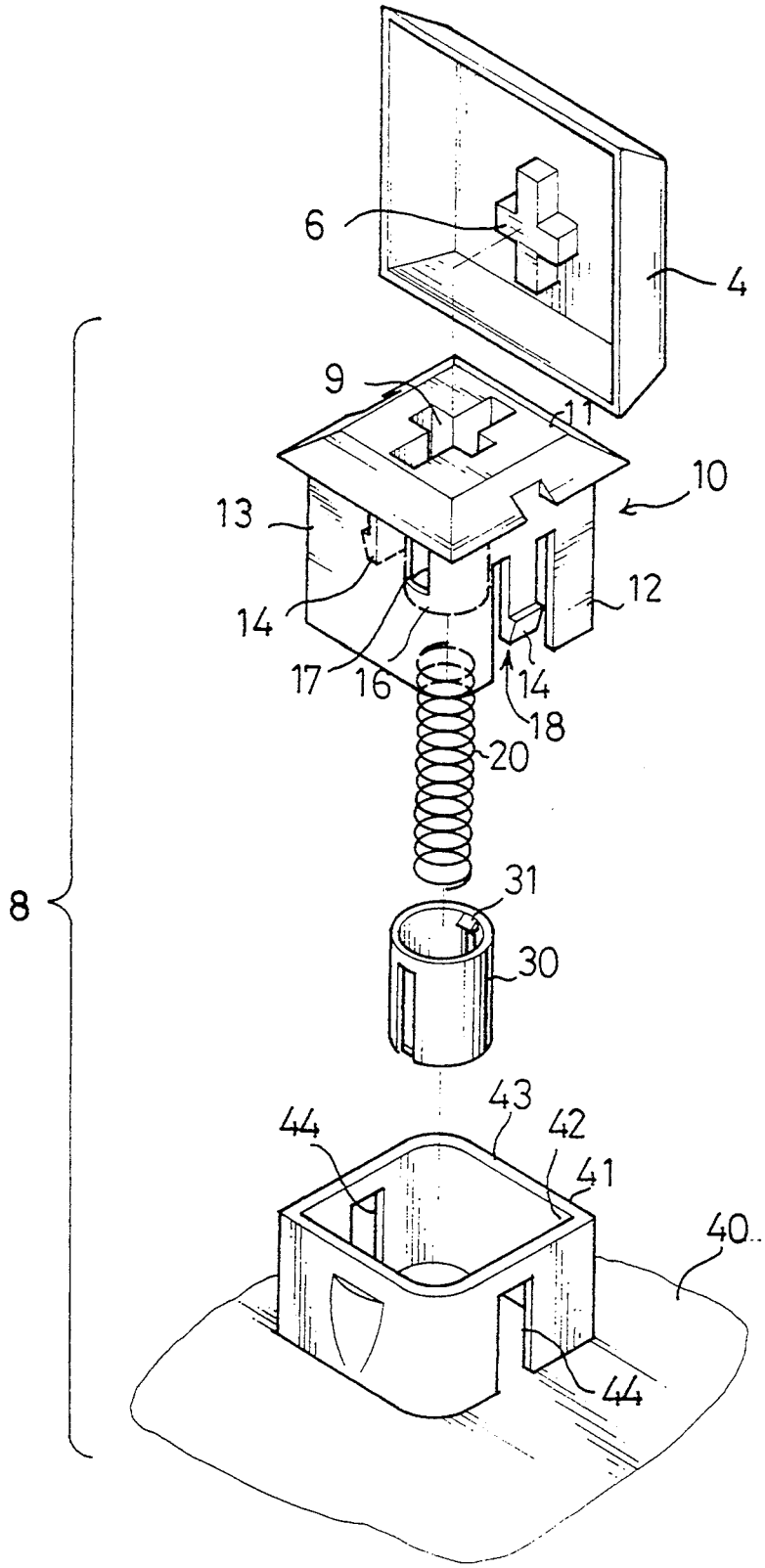
FIG. 1 is an exploded view of the preferred embodiment of a key switch in accordance with this invention.

Referring to FIG. 1, a key includes a key top 4 and a key switch 8. The key top 4 is mounted on a key switch 8. The key top includes a protrusion 6 projecting from a lower surface. The protrusion 6 is insertable into a recess 9 defined in the key switch 8 to be described, thus the key top 4 is attached to the key switch 8.

The key switch 8 includes a slidable member 10 with a square plate 11 defining the recess 9 for receiving the protrusion 6. Two slides 12 project downwardly from a lower surface of the plate 11. Each of the slides 12 will be in the form of "U" if it is shown in a bottom view. Two hooks 18 project from the lower surface of the plate 11. A barb 14 is formed on a free end of each of the hooks 18. A hollow cylinder 16 projects from the lower surface of the plate 11. Two vertical slots 17 (only one is shown) are defined in the hollow cylinder 16.

A spring 20 is receivable in the hollow cylinder 16.

A cup 30 includes a wall and a bottom. Two barbs 31 (only one is shown) are formed on an internal surface of the wall of the cup 30.

The hollow cylinder 16 is insertable into the cup 30. The barbs 31 are slidably received in the vertical slots 17. Thus, the hollow cylinder 16 is retained in the cup 30.

A frame 41 is mounted on a panel 40 of a keyboard (not shown). The frame 41 includes an upper edge 43. Two vertical slots 44 are defined in the frame 41.

The slides 12 are engageable with the frame 41 so that the slidable member 10 is smoothly slidable relative to the frame 41. The barbs 14 are engageable in the slots 44 so that the slidable member 10 is retained together with the frame 41.

Figure 2:
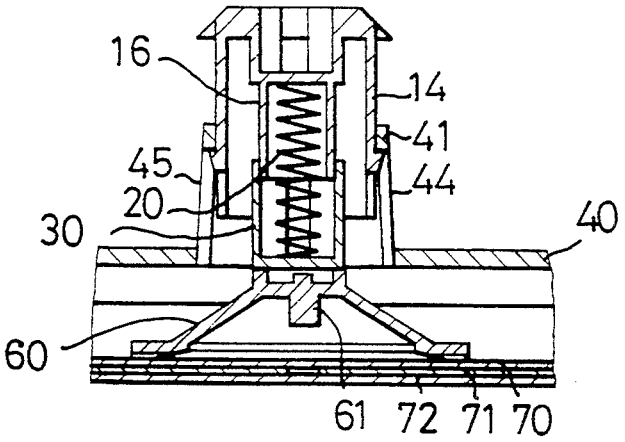
FIG. 2 is a cross-sectional view of the preferred embodiment of a key switch according to this invention.

Referring to FIG. 2, the cup 30 is insertable through an aperture defined in the panel 40.

A first circuit which includes a plurality of contacts (only one is shown) is printed on a lower surface of a film 70. A corresponding number of apertures (only one is shown) are defined in a film insulator 71. A second circuit which includes a corresponding number of contacts (only one is shown) is printed on an upper surface of a film 72. The film insulator 71 is sandwiched between the films 70 and 72 so that the first and second circuits are insulated. The film 72 is mounted on a base (not shown) of the keyboard. The keys mounted on the keyboard are aligned with the contacts of the first circuit. The contacts of the first circuit are aligned with the contacts of the second circuit.

A resilient member 60 is formed as an inverted funnel, i.e., it includes a closed upper end and an open lower end wherein the area of the closed upper end of the resilient member 60 is smaller than the area of the lower end of the resilient member 60. A boss 61 projects downwardly from the closed upper end of the resilient member 60.

Figure 3:
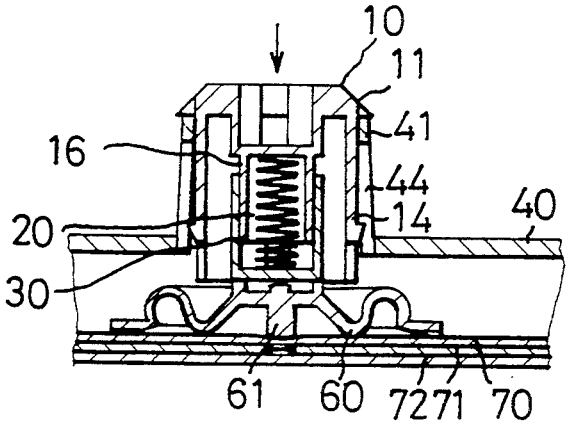
FIG. 3 is a similar view to FIG. 2 but showing the key switch in a pressed position.

The key top 4 can be pressed in order to move the boss 61 for engaging one of the contacts of the first circuit with one of the contacts of second circuit through one of the apertures defined in the film insulator 71. The movement of the key switch 8 from a position shown in FIG. 2 to a position shown in FIG. 3 involves two important transient positions. In the first transient position, the spring 20 is compressed, the resilient member 60 is not compressed. That is, the recovery force of the spring 20 is smaller than a yielding point of the resilient member 60. In the second transient position, the recovery force of the spring 20 just exceeds the yielding point of the resilient member 60 so that the resilient member 60 is compressed. A result of the recovery force of the spring 20 minus the resistance of the resilient member 60 quickly extends the spring 20, i.e., thus moving the cup 30 from the hollow cylinder 16. The barbs 31 strike the hollow cylinder 16 thus making a click. As shown in FIG. 3, the resilient member 60 is compressed so that the boss 61 is abutted against the film 70 at a point corresponding to one of the contacts of the first circuit. One of the contacts of the first circuit is engaged with one of the contacts of the second circuit through one of the apertures defined in the film insulator 71.

As described above, the key switch 8 will click if the key top 4 is pressed efficiently. The key switch 8 is installed on a keyboard without soldering, thus reducing the cost resulting from manufacturing of the keyboard. If the key switch 8 malfunctions, it can be individually repaired or replaced with a new key switch 8, thus reducing the cost resulting from maintaining of the keyboard.

What is claimed is:

1. A key switch adapted to be mounted on a keyboard for engaging a contact of a first circuit with a contact of a second circuit through an aperture defined in a film insulator sandwiched between the first circuit and the second circuit wherein the key switch comprises:

a frame which is adapted to be mounted on the keyboard and defines two vertical slots;

a slidable member including a plate, two hooks projecting downwardly from the plate and each including a barb for engaging with one of the vertical slots and a hollow cylinder projecting downwardly from the plate and defining two vertical slots;

a cup including two barbs projecting radially inwardly therefrom wherein the barbs formed on the cup are engageable in the slots defined in the hollow cylinder when the hollow cylinder is inserted in the cup;

a spring received in the hollow cylinder and the cup for biasing the cup from the hollow cylinder;

an inverted funnel-shaped resilient member with a closed upper end for supporting the cup, open lower end adapted to be mounted on the first circuit and a boss projecting downwardly from the closed upper end for engaging the contact of the first circuit with the contact of the second circuit upon depression of said slideable member.

2. A key switch in accordance with claim 1 wherein the slidable member includes two slides projecting downwardly from the plate thereof wherein the slides match the frame so that the slidable member is smoothly slidable relative to the frame.

3. A key switch in accordance with claim 2 wherein each of the slides includes an U-shaped configuration in a cross-sectional view.

* * * * *